US007598800B2

(12) United States Patent
Thandi et al.

(10) Patent No.: US 7,598,800 B2
(45) Date of Patent: Oct. 6, 2009

(54) METHOD AND CIRCUIT FOR AN EFFICIENT AND SCALABLE CONSTANT CURRENT SOURCE FOR AN ELECTRONIC DISPLAY

(75) Inventors: Gurjit S. Thandi, San Jose, CA (US); Dilip S, Saratoga, CA (US); Hendrik Santo, San Jose, CA (US); Kien Vi, Palo Alto, CA (US)

(73) Assignee: mSilica Inc, Santa Clara, CA (US)

( * ) Notice: Subject to any disclaimer, the term of this patent is extended or adjusted under 35 U.S.C. 154(b) by 35 days.

(21) Appl. No.: 11/805,523

(22) Filed: May 22, 2007

(65) Prior Publication Data

US 2008/0290933 A1 Nov. 27, 2008

(51) Int. Cl.
*G05F 1/10* (2006.01)

(52) U.S. Cl. ..... 327/540; 323/316

(58) Field of Classification Search ..... None
See application file for complete search history.

(56) References Cited

U.S. PATENT DOCUMENTS

| | | | | |
|---|---|---|---|---|
| 4,982,192 | A * | 1/1991 | Murooka | 341/127 |
| 5,519,310 | A * | 5/1996 | Bartlett | 323/316 |
| 5,629,611 | A | 5/1997 | McIntyre | |
| 5,639,163 | A * | 6/1997 | Davidson et al. | 374/178 |
| 5,739,712 | A * | 4/1998 | Fujii | 327/323 |
| 5,764,041 | A * | 6/1998 | Pulvirenti et al. | 323/282 |
| 5,847,556 | A * | 12/1998 | Kothandaraman et al. | 323/315 |
| 6,433,528 | B1 * | 8/2002 | Bonelli et al. | 323/315 |
| 6,621,235 | B2 * | 9/2003 | Chang | 315/216 |
| 6,860,576 | B2 * | 3/2005 | Kawasaki et al. | 347/14 |
| 7,443,327 | B2 * | 10/2008 | Chida et al. | 341/144 |
| 2002/0135424 | A1 | 9/2002 | Oikawa | |
| 2005/0253645 | A1 * | 11/2005 | North | 327/543 |
| 2005/0259054 | A1 * | 11/2005 | Wu | 345/82 |
| 2006/0125808 | A1 | 6/2006 | Kim et al. | |
| 2006/0279562 | A1 * | 12/2006 | Emek et al. | 345/207 |
| 2007/0257880 | A1 * | 11/2007 | Nakao et al. | 345/102 |
| 2008/0042741 | A1 * | 2/2008 | Chen | 327/543 |
| 2008/0136338 | A1 * | 6/2008 | Troccoli et al. | 315/169.3 |

OTHER PUBLICATIONS

International Search Report for PCT/US08/64271, mailed Aug. 22, 2008.

* cited by examiner

*Primary Examiner*—Lincoln Donovan
*Assistant Examiner*—Thomas J Hiltunen
(74) *Attorney, Agent, or Firm*—Turocy & Watson, LLP

(57) ABSTRACT

The present invention uses two transistors instead of a sensing resistor to provide a constant current source for a load such as an array of light emitting diodes ("LEDs"). In the present invention, a bias current is applied to a branch of the circuit. The drain-to-source voltages of two transistors are matched. The voltage at the gate of both transistors is controlled based on the bias current and the drain-to-source current of the first of the two transistors. The second of the two transistors is sized such that source current of the second transistor is a multiple of the source current of the first transistor for a given gate voltage. By the techniques of this invention, the load current in a circuit is efficiently kept constant at a multiple of the input bias current.

9 Claims, 6 Drawing Sheets

METHOD AND CIRCUIT FOR AN EFFICIENT AND SCALABLE CONSTANT CURRENT SOURCE FOR AN ELECTRONIC DISPLAY

FIELD OF INVENTION

The present invention relates to current sources, and more particularly, to a current source for use with light emitting diode (LED) strings of the backlights of electronic displays.

BACKGROUND OF THE INVENTION

Backlights are used to illuminate liquid crystal displays (LCDs). LCDs with backlights are used in small displays for cell phones and personal digital assistants (PDAs) as well as in large displays for computer monitors and televisions. Often, the light source for the backlight includes one or more cold cathode fluorescent lamps (CCFLs). The light source for the backlight can also be an incandescent light bulb, an electroluminescent panel (ELP), or one or more hot cathode fluorescent lamps (HCFLs).

The display industry is enthusiastically pursuing the use of LEDs as the light source in the backlight technology because CCFLs have many shortcomings: they do not easily ignite in cold temperatures, they require adequate idle time to ignite, and they require delicate handling. Moreover, LEDs generally have a higher ratio of light generated to power consumed than the other backlight sources. Because of this, displays with LED backlights can consume less power than other displays. LED backlighting has traditionally been used in small, inexpensive LCD panels. However, LED backlighting is becoming more common in large displays such as those used for computers and televisions. In large displays, multiple LEDs are required to provide adequate backlight for the LCD display.

Circuits for driving multiple LEDs in large displays are typically arranged with LEDs distributed in multiple strings. FIG. 1 shows an exemplary flat panel display 10 with a backlighting system having three independent strings of LEDs 1, 2 and 3. The first string of LEDs 1 includes 7 LEDs 4, 5, 6, 7, 8, 9 and 11 discretely scattered across the display 10 and connected in series. The first string 1 is controlled by the drive circuit 12. The second string 2 is controlled by the drive circuit 13 and the third string 3 is controlled by the drive circuit 14. The LEDs of the LED strings 1, 2 and 3 can be connected in series by wires, traces or other connecting elements.

FIG. 2 shows another exemplary flat panel display 20 with a backlighting system having three independent strings of LEDs 21, 22 and 23. In this embodiment, the strings 21, 22 and 23 are arranged in a vertical fashion. The three strings 21, 22 and 23 are parallel to each other. The first string 21 includes 7 LEDs 24, 25, 26, 27, 28, 29 and 31 connected in series, and is controlled by the drive circuit, or driver, 32. The second string 22 is controlled by the drive circuit 33 and the third string 23 is controlled by the drive circuit 34. One of ordinary skill in the art will appreciate that the LED strings can also be arranged in a horizontal fashion or in another configuration.

An important feature for displays is the ability to control the brightness. In LCDs, the brightness is controlled by changing the intensity of the backlight. The intensity of an LED, or luminosity, is a function of the current flowing through the LED. FIG. 3 shows a representative plot of luminous intensity as a function of forward current for an LED. As the current in the LED increases, the intensity of the light produced by the LED increases. Therefore, the current in the backlight strings must be controlled and be stable in order to control and maintain the backlight intensity.

To generate a stable current, circuits for driving LEDs use constant current sources. A constant current source is a source that maintains current at a constant level irrespective of changes in the drive voltage. FIG. 4 is a representation of a circuit used to generate a constant current. The operational amplifier 40 of FIG. 4 has a non-inverting input 41, an inverting input 42, and an output 43. To create a constant current source, the output of the amplifier 40 may be connected to the gate of a transistor 44. The transistor 44 is shown in FIG. 4 as a field effect transistor ("FET"), but other types of transistors may be used as well. The drain of the transistor is connected to the load, which in FIG. 4 is an array of LEDs 45. The inverting input of the amplifier 40 is connected to the source of the transistor 44. The source of the transistor 44 is also connected to ground through a sensing resistor $R_S$ 46. When a reference voltage is applied to the non-inverting input of the amplifier 40, the amplifier increases the output voltage until the voltage at the inverting input matches the voltage at the non-inverting input. As the voltage at the output of the amplifier 40 increases, the voltage at the gate of the transistor 44 increases. As the voltage at the gate of the transistor 44 increases, the current from the drain to the source of the transistor 44 increases.

FIG. 5 illustrates a typical relationship between the source current and the gate voltage for an exemplary transistor. Since little to no current flows into the inverting input of the amplifier 40, the increased current passes through the sensing resistor $R_S$ 46. As the current across the sensing resistor $R_S$ 46 increases, the voltage drop across the sensing resistor $R_s$ 46 increases according to Ohm's law: voltage drop (V)=current (i)*resistance (R). This process continues until the voltage at the inverting input of the amplifier 40 equals the voltage at the non-inverting input. If, however, the voltage at the inverting input is higher than that at the non-inverting input, the voltage at the output of the amplifier 40 decreases. That in turn decreases the source voltage of the transistor 44 and hence decreases the current that passes from the drain to the source of the transistor 44. Therefore, the circuit of FIG. 4 keeps the voltage at the inverting input and the source side of the transistor 44 equal to the voltage applied to the non-inverting input of the amplifier 40 irrespective of changes in the drive voltage $V_{SET}$.

One of the limitations of the constant current source of FIG. 4 is that it is not readily scalable. For a given input voltage on the non-inverting input of the amplifier 40, the only way to adjust the source current and hence the current in the load is to change the resistance of the sensing resistor 46. Variable resistors or potentiometers are prohibitively expensive and large. Changing the sensing resistor 46 to scale the current is not practical for many applications.

Another limitation of the constant current source of FIG. 4 is that it is increasingly inefficient at higher currents. When current passes through the sensing resistor 46, power is dissipated according to the following relationship: power dissipated (P)=current$^2$ ($i^2$)*resistance (R). Therefore, at increased currents, a larger amount of power is dissipated in the sensing resistor $R_S$ 46.

In the prior art, if the sensing resistor is integrated inside the integrated circuit, then there are problems with current source accuracy due to temperature changes. As power is dissipated, the temperature of the sensing resistor increases. As the temperature of the resistor changes, the resistance of the resistor changes unless the resistor is a zero thermal coefficient resistor. As the resistance of the sensing resistor changes, the current in the load changes according to Ohm's Law. Most foundry processes do not use a process that can generate a resistor with zero thermal coefficient behavior. A few processes can fabricate thin film resistors with a temperature coefficient close to zero, however these processes add cost and complexity to the integrated circuit fabrication process.

For incorporation into integrated circuits, a further limitation of the constant current source of FIG. 4 is that the surface area of the sensing resistor $R_S$ 46 may be inconveniently large for many applications. For example, if the voltage at the non-inverting input of the amplifier 40 is 150 mV and the desired source current is 20 mA, the resistance of the sensing resistor $R_S$ 46 must be 150 mV/20 mA=7.5%. The length (L) of the resistor divided by the width (W) of the resistor equals the resistance of the resistor divided by the sheet resistance $R_{SH}$. That is, $L/W=7.5\Omega/R_{SH}$. Assuming the contact resistance is negligible and the resistor is made of a metal with a sheet resistance $R_{SH}$ of 60 mΩ/□, then L/W=7.5Ω/60 mΩ/□=125. If the contact density of the chip used for the constant current source is 0.5 mA/contact, then the number of contacts will be 20 mA/0.5 mA, or 40. Assuming the contact width is 0.4 μm and the space between each contact is 0.7 μm, then the total width required for contacts is 44 μm. Since L/W equals 125 above, L equals 125*44 μm. So L equals 5,500 μm. This rough calculation indicates the sensing resistor 46 may be 242,000 $\mu m^2$. This is a significant amount of the space on a typical semiconductor chip.

The resistor surface areas required by the previous designs are impractical for integrated circuits in high-current applications. The present invention overcomes many of the limitations of the prior art current sources through innovative systems and methods for providing a constant current source that is scalable and efficient.

SUMMARY OF THE INVENTION

The techniques of the present invention relate to efficiently providing constant current in LED circuits. In the present invention, a bias current is applied to a branch of the circuit. The drain-to-source voltages of two transistors are matched. The voltage at the gate of both transistors is controlled based on the bias current and the drain-to-source current of the first of the two transistors. The second of the two transistors is sized such that source current of the second transistor is a multiple of the source current of the first transistor for any gate voltage. By the techniques of this invention, the load current in a circuit is efficiently kept constant at a multiple of the input bias current.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTION OF THE INVENTION

The present invention relates to current sources, and more particularly, to a current source for use with LED strings of the backlights of electronic displays. The methods and circuits of the present invention provide a constant current source without requiring the sensing resistor of the typical constant current source of the prior art.

Figure 1:
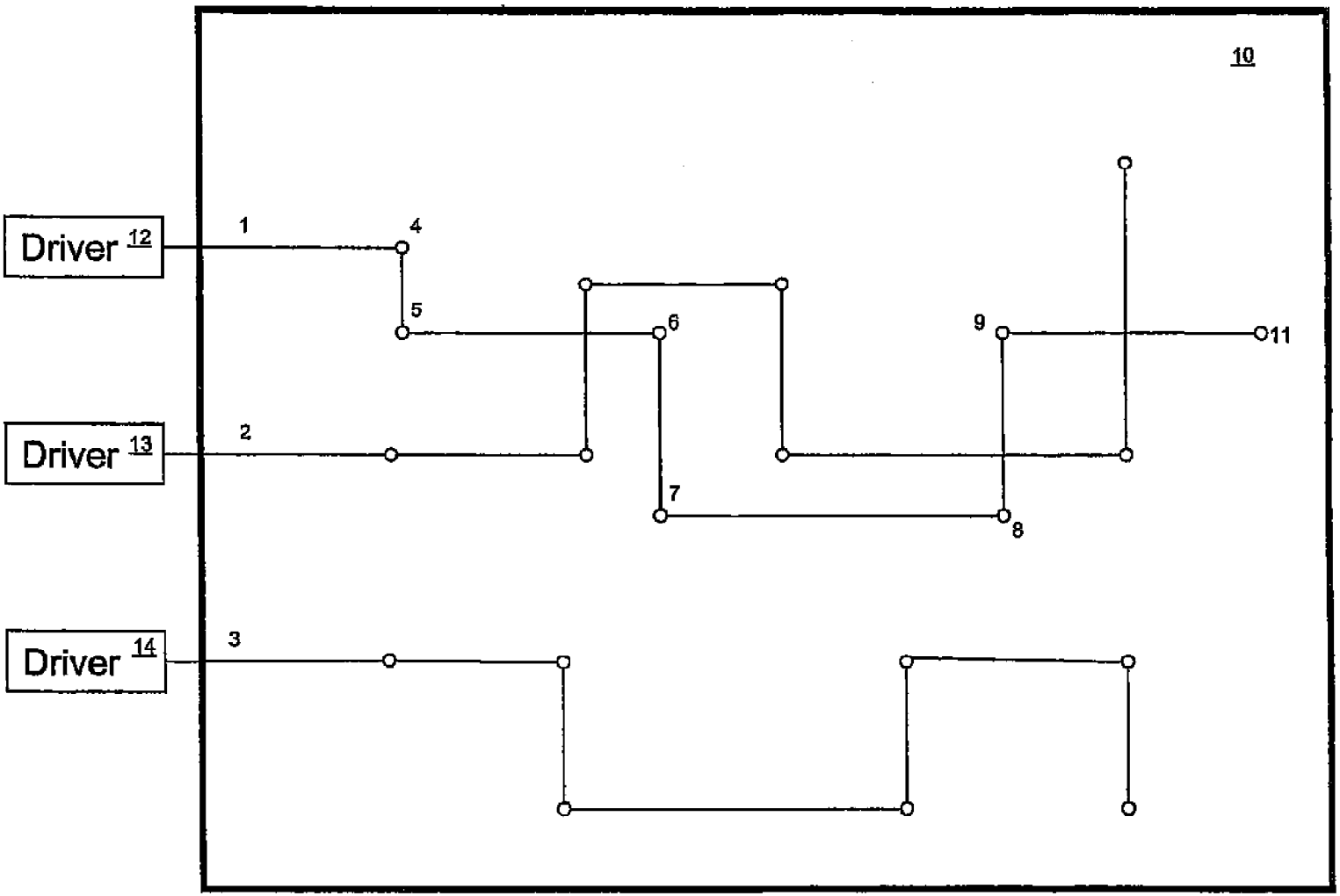
PRIOR ART FIG. 1
FIG. 1 illustrates an exemplary display implementing LED strings.
Figure 2:
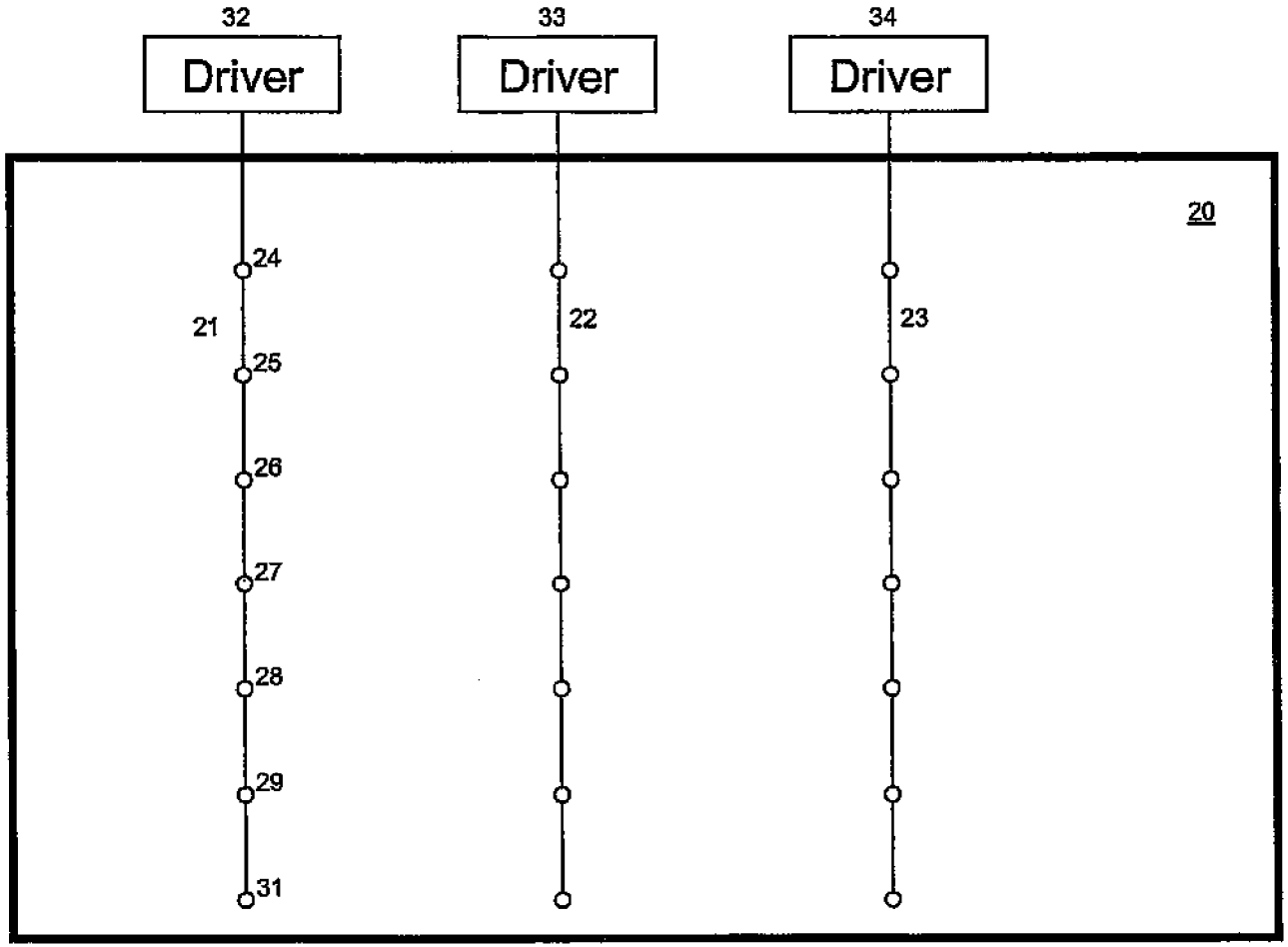
PRIOR ART FIG. 2
FIG. 2 illustrates another exemplary display implementing LED strings.
Figure 3:
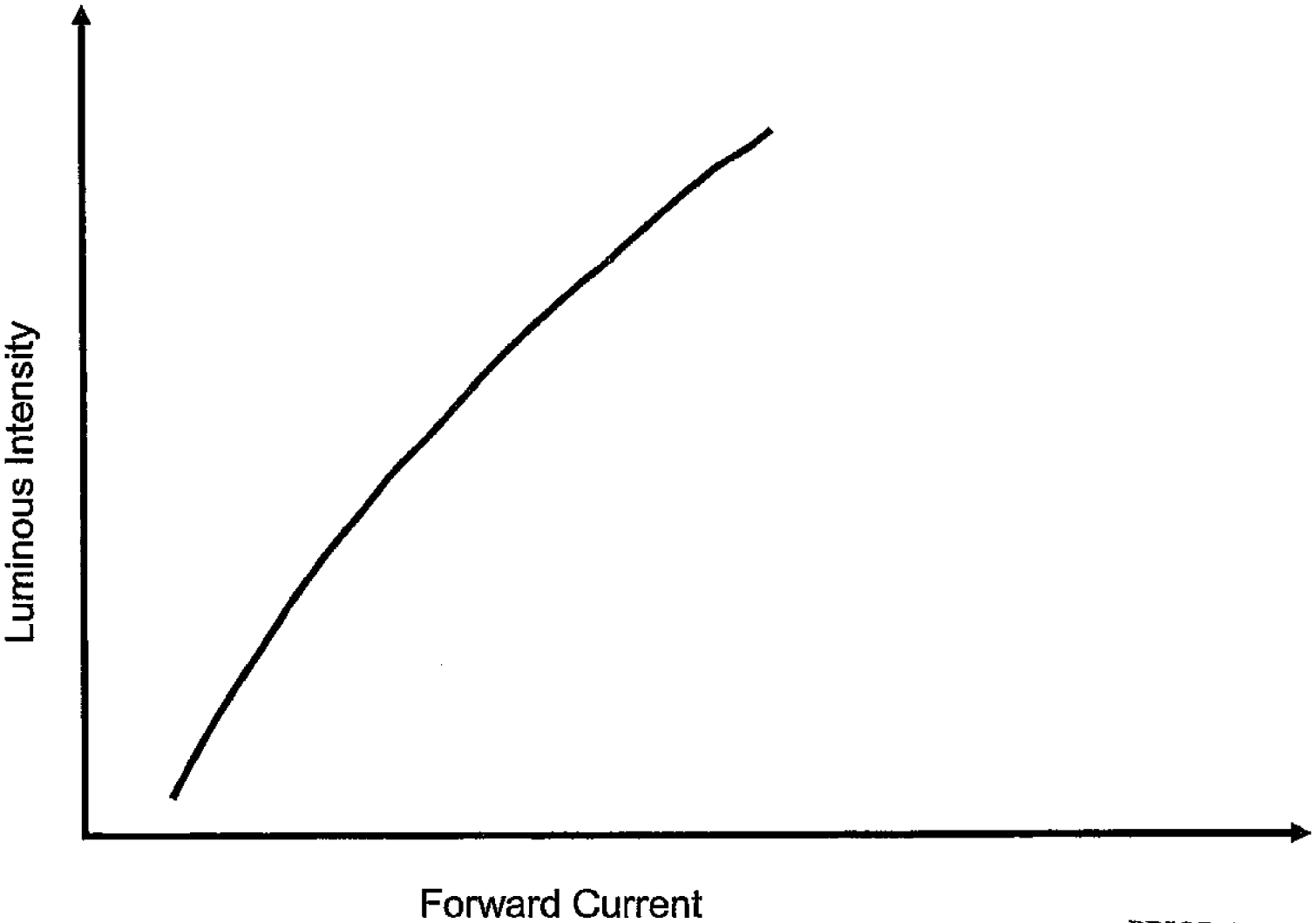
PRIOR ART FIG. 3
FIG. 3 illustrates a graph showing the relationship between current and luminous intensity in an LED.
Figure 4:
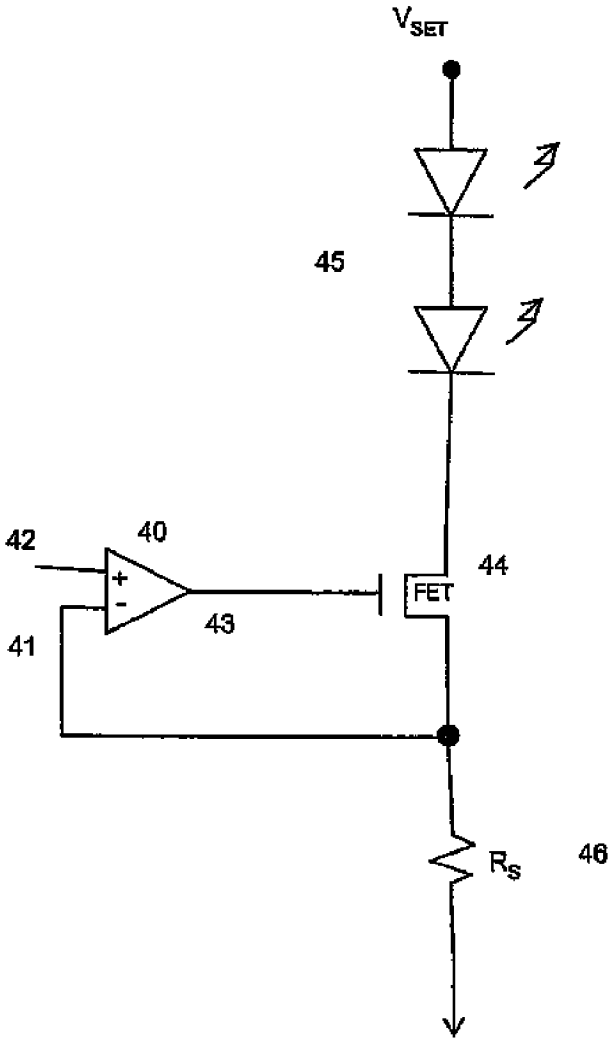
PRIOR ART FIG. 4
FIG. 4 illustrates a prior art technique for providing constant current source.
Figure 5:
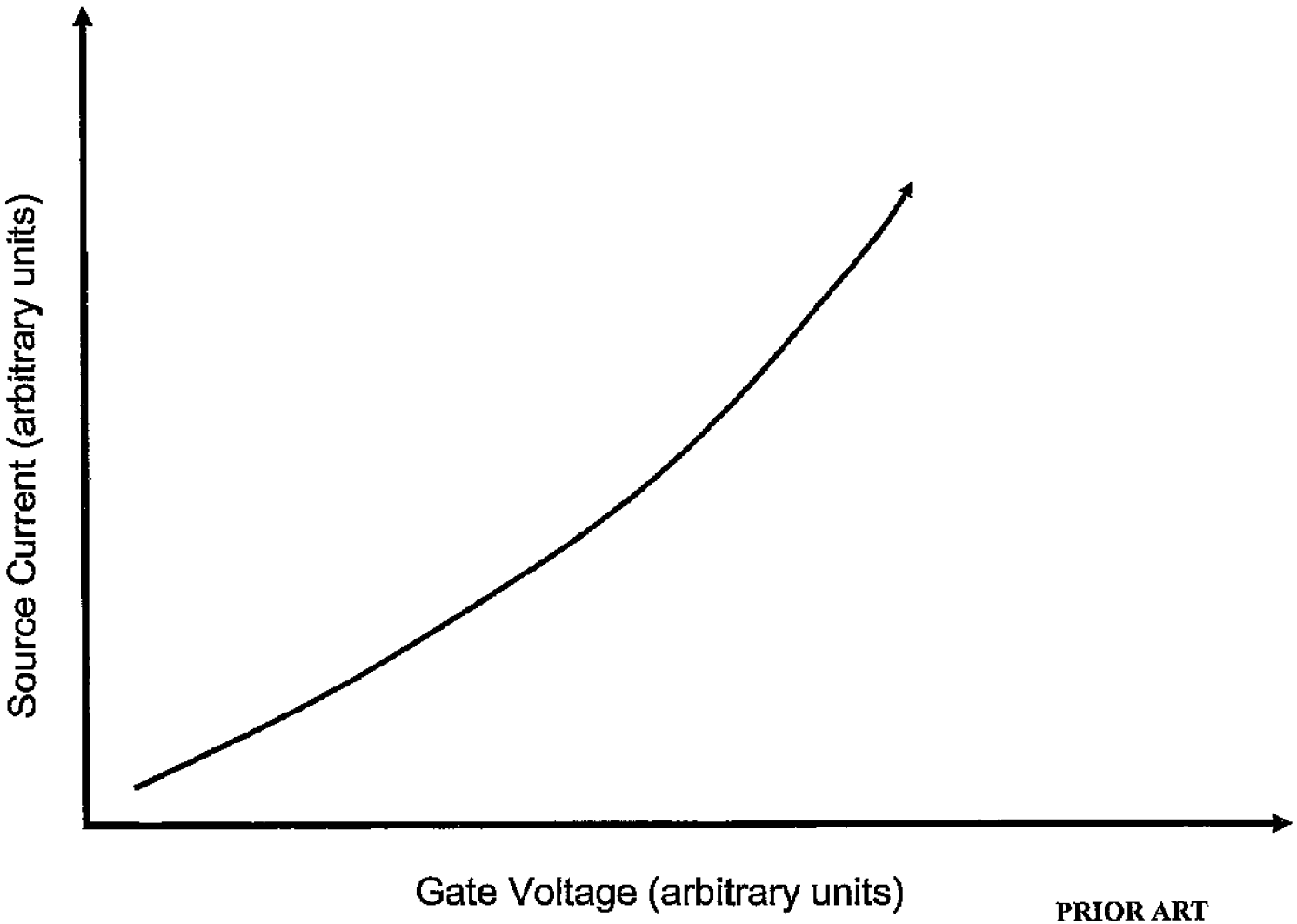
PRIOR ART FIG. 5
FIG. 5 illustrates a graph showing the relationship between gate voltage and source current in a transistor.
Figure 6:
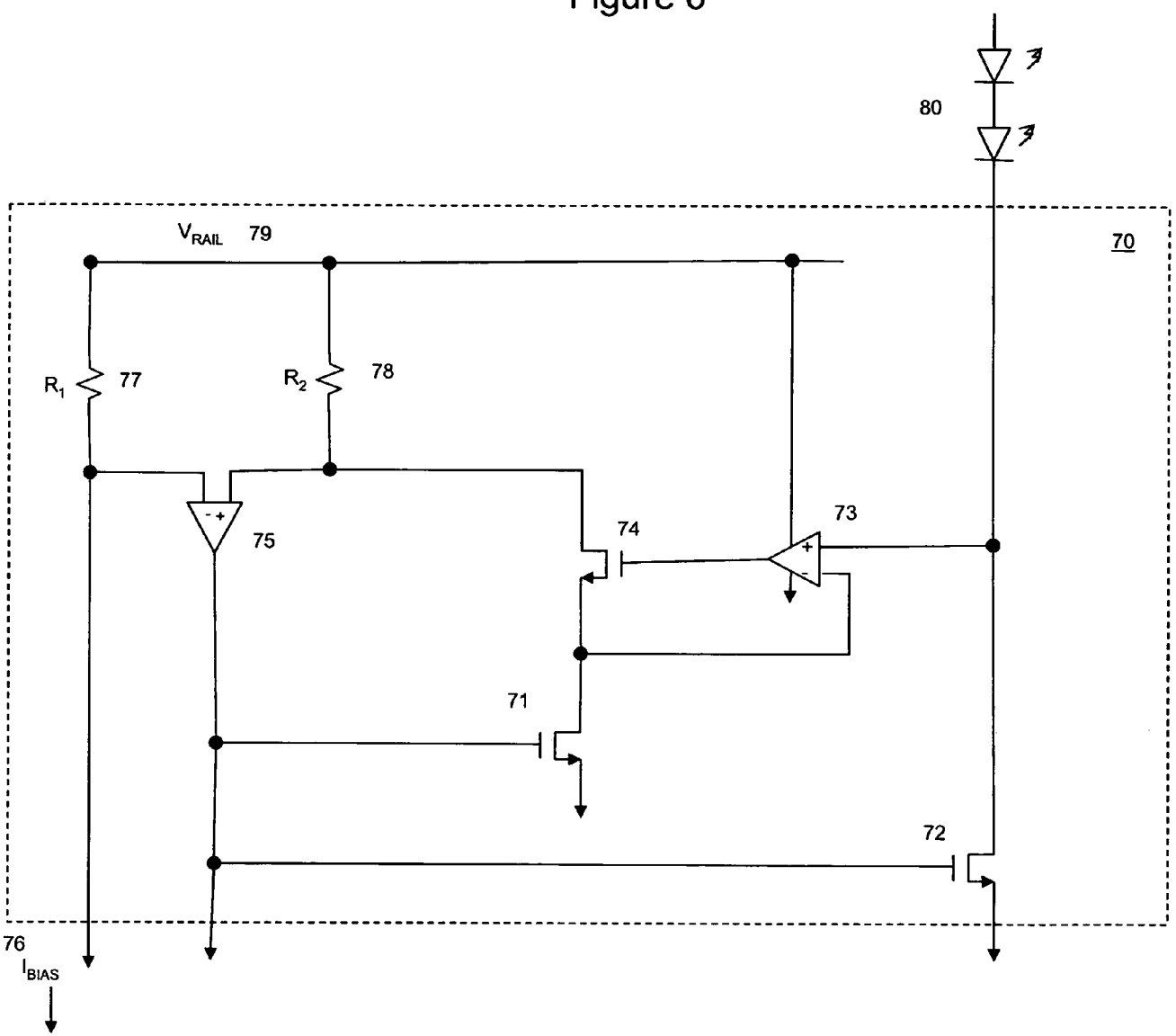
FIG. 6 illustrates an exemplary embodiment of efficient constant current source circuit of the present invention.

FIG. 6 shows an exemplary constant current source circuit 70 of the present invention. The present invention uses a first transistor 71 and a second transistor 72. The first transistor 71 has a drain, a source, and a gate terminal. The second transistor 72 also has a drain, a source, and a gate terminal. The two transistors 71, 72 are matched such that the source current of the second transistor is a multiple of the source current of the first transistor for a given drain-to-source voltage and gate voltage. The source current for a given drain-to-source voltage and a given gate voltage is determined by the size of the transistor (e.g., the width-to-length ratios of the FETs, or the area of the bipolar transistors).

In the exemplary embodiment of FIG. 6, the sources of the two transistors 71, 72 are kept at the same voltage by tying them to ground or common for example. The voltages at the drains of the two transistors 71, 72 are kept the same by using an operational amplifier 73 and third transistor 74 in this example. The third operational amplifier 73 and transistor 74 regulate the current and voltage at the drain of the first transistor 71.

In the exemplary embodiment of FIG. 6, the gates of the two transistors 71, 72 are tied to the output of a second operational amplifier 75. A bias current $I_{BIAS}$ 76 is applied to the inverting input of the second operational amplifier 75. The bias current $I_{BIAS}$ 76 induces a voltage drop across the resistor $R_1$ 77. The voltage at the inverting input of the operational amplifier 75 is equal to the voltage on $V_{RAIL}$ 79 minus the voltage drop across $R_1$ 77. In this exemplary embodiment, $V_{RAIL}$ 79 provides a constant voltage available to all components. The non-inverting input of the operational amplifier 75 is also tied to $V_{RAIL}$ 79 through a second resistor $R_2$ 78. The voltage at the non-inverting input of the operational amplifier 75 is equal to the voltage on $V_{RAIL}$ 79 minus the voltage drop across $R_2$ 78. The operational amplifier 75 will increase or decrease the voltage at its output until the voltage at its inverting input matches the voltage at its non-inverting input. As the voltage at the output of the operational amplifier 75 increases, more current passes through the first transistor 71 since the gate of the first transistor 71 is tied to the output of the operational amplifier 75. The current passing through the first transistor 71 is the same as the current passing through $R_2$ 78 since they are in series in the circuit. Therefore, the current through the transistor 71 will increase or decrease until the voltage drop across $R_2$ 78 equals the voltage drop across $R_1$ 77. In the preferred embodiment of the present invention the resistance of $R_1$ 77 is equal to the resistance of $R_2$ 78. In this case, the operational amplifier 75 adjusts its output voltage until the current passing through the first transistor 71 equals the bias current 76.

Since the gate of the second transistor 72 is tied to the gate of the first transistor 71, the gate voltages of both transistors will be equal. As discussed above, the drain-to-source voltages of both the first 71 and second 72 transistors will also be equal. So, the source current of the second transistor 72 will be a multiple of the source current of the first transistor 71 as determined by the sizing of the two transistors. Therefore, the source current of the second transistor 72 will be a multiple of the bias current 76 applied to the circuit. The source current of the second transistor 72 is also the current in the load 80 since the load and the second transistor 72 are in series.

In the preferred embodiment of the present invention, the size of the second transistor 72 is chosen such that its source current is between 900 and 1100 times that of the first transistor 71 for the same drain-to-source voltage and gate voltage. In this case, the source current in the second transistor 72 is between 900 and 1100 times the bias current 76 applied to the circuit. Therefore, the current in the load 80 is between 900 and 1100 times the bias current 76 applied to the circuit.

The present invention is scalable because the current in the load 80 is proportional to the bias current 76. To increase the current in the load 80, the bias current 76 is increased. In the prior art, the sensing resistor 46 controls the current in the load. Therefore, in the prior art, the resistance of the sensing resistor 46 has to be changed in order to change the current in the load.

The present invention solves the scalability, efficiency, and size limitations of the prior art. The present invention does not use a sensing resistor 46 like the prior art. Since the present invention does not have a sensing resistor 46 it does not dissipate the load current through a resistor. This makes the present invention more efficient at higher currents. Further, since the present invention does not use a sensing resistor 46 it does not sacrifice the significant chip area required for the sensing resistor at high currents if implemented in an integrated circuit. Further, the present invention reduces the problem of thermal-induced current drift associated with the prior art solution.

One of ordinary skill in the art will appreciate that the techniques, structures and methods of the present invention above are exemplary. The present inventions can be implemented in various embodiments without deviating from the scope of the invention.

The invention claimed is:

1. A constant current source circuit comprising:

a first operational amplifier having a non-inverting input, an inverting input, and an output;

a reference current source coupled to the inverting input of the first operational amplifier, wherein the reference current determines the voltage applied to the inverting input;

a first transistor having gate, drain and source terminals and having a source current that is a function of the drain-to-source voltage and the gate voltage and is independent of an additional offset current, wherein the drain terminal of the first transistor is in series with the non-inverting input of the first operational amplifier and wherein the gate terminal of the first transistor is connected to the output of the first operational amplifier;

a second transistor having gate, drain and source terminals and having a source current that is a function of the drain-to-source voltage and the gate voltage and is independent of an additional offset current, wherein the gate terminal of the second transistor is connected to the output of the first operational amplifier and wherein the source current of the second transistor is a multiple of the source current of the first transistor for a given voltage on the output of the first operational amplifier;

a third transistor having gate, drain and source terminals, wherein the drain terminal of the third transistor is connected to the non-inverting input of the first operational amplifier; and a second operational amplifier having a non-inverting input, an inverting input, and an output, wherein the inverting input of the second operational amplifier is connected to the source terminal of the third transistor and to the drain terminal of the first transistor, and wherein the non-inverting input of the second operational amplifier is connected to the drain terminal of the second transistor.

2. The constant current source of claim 1, wherein at least one of the transistors is a field effect transistor.

3. The constant current source of claim 1, further comprising a light emitting diode coupled to the drain of the second transistor.

4. The constant current source of claim 1, further comprising a light emitting diode coupled to the non-inverting input of the second operational amplifier.

5. The constant current source of claim 1, further comprising a voltage source coupled to the inverting input of the first operational amplifier by way of a first resistor.

6. The constant current source of claim 1, further comprising a voltage source coupled to the non-inverting input of the first operational amplifier by way of a second resistor.

7. The constant current source of claim 1, wherein the constant current source is incorporated in a flat panel display.

8. A flat panel display including a constant current source circuit comprising:

a first operational amplifier having a non-inverting input, an inverting input, and an output;

a reference current source coupled to the inverting input of the first operational amplifier, wherein the reference current determines the voltage applied to the inverting input;

a first transistor having gate, drain and source terminals and having a source current that is a function of the drain-to-source voltage and the gate voltage and is independent of an additional offset current, wherein the drain terminal of the first transistor is in series with the non-inverting input of the first operational amplifier and wherein the gate terminal of the first transistor is connected to the output of the first operational amplifier;

a second transistor having gate, drain and source terminals and having a source current that is a function of the drain-to-source voltage and the gate voltage and is independent of an additional offset current, wherein the, gate terminal of the second transistor is connected to the output of the first operational amplifier and wherein the source current of the second transistor is a multiple of the source current of the first transistor for a given voltage on the output of the first operational amplifier;

a third transistor having gate, drain and source terminals, wherein the drain terminal of the third transistor is connected to the non-inverting input of the first operational amplifier; and a second operational amplifier having a non-inverting input, an inverting input, and an output, wherein the inverting input of the second operational amplifier is connected to the source terminal of the third transistor and to the drain terminal of the first transistor, and wherein the non-inverting input of the second operational amplifier is connected to the drain terminal of the second transistor.

9. The flat panel display of claim 8, wherein at least one of the transistors is a field effect transistor.

* * * * *